United States Patent [19]

Fabrig

[11] 4,313,703

[45] Feb. 2, 1982

[54] APPARATUS FOR BREAKING UP STACKS OF PAPER SHEETS OR THE LIKE

[75] Inventor: Paul Fabrig, Neuffen, Fed. Rep. of Germany

[73] Assignee: Womako Maschinenkonstruktionen GmbH, Nürtingen, Fed. Rep. of Germany

[21] Appl. No.: 91,080

[22] Filed: Nov. 5, 1979

[30] Foreign Application Priority Data

Nov. 17, 1978 [DE] Fed. Rep. of Germany ..... 2849949

[51] Int. Cl.[3] ..... B65G 59/06

[52] U.S. Cl. ..... 414/115; 414/128; 414/907

[58] Field of Search ..... 414/114, 115, 125, 128, 414/907; 271/160, 165, 220

[56] References Cited

U.S. PATENT DOCUMENTS

| | | | |
|---|---|---|---|
| 3,155,244 | 11/1964 | Rogers et al. | 414/115 |
| 3,327,873 | 6/1967 | Malamood et al. | 414/115 |
| 3,576,261 | 4/1971 | Stacy | 414/115 |
| 3,690,475 | 9/1972 | Pfaffle | 414/115 |
| 3,690,476 | 9/1972 | Stacy | 414/115 |
| 3,805,971 | 4/1974 | Behrens et al. | 414/907 X |
| 3,834,290 | 9/1974 | Nelson | 414/907 X |
| 3,981,494 | 9/1976 | Prestegaard | 414/128 X |
| 4,155,546 | 5/1979 | Jacobs | 271/160 X |

FOREIGN PATENT DOCUMENTS 2225063 12/1973 Fed. Rep. of Germany ..... 414/114

*Primary Examiner*—Leslie J. Paperner
*Attorney, Agent, or Firm*—Peter K. Kontler

[57] ABSTRACT

Apparatus for breaking up stacks of paper sheets or the like into two or more thinner layers has a tongs having an upper and a lower idler roller, a reciprocable sword-like dividing tool which can penetrate into an edge face of a stack extending into the space between the rollers, a spring which biases the upper roller against the topmost sheet of the stack, a mechanism for moving the lower roller along a path wherein the lower roller has at least one component of movement at right angles to the planes of sheets between the rollers, and a mechanism for reciprocating the tool in synchronism with movements of the lower roller. The lower roller moves downwardly and away from the upper roller and away from the tool at least when the latter penetrates between the jaws above the last layer, and the lower roller is thereupon lifted to a predetermined operative position when the last layer of a stack is removed from the dividing station.

17 Claims, 4 Drawing Figures

APPARATUS FOR BREAKING UP STACKS OF PAPER SHEETS OR THE LIKE

BACKGROUND OF THE INVENTION

The present invention relates to apparatus for breaking up stacks of paper sheets or the like into smaller stacks or layers. More particularly, the invention relates to improvements in apparatus wherein successive stacks are broken up by a sword-like dividing member (hereinafter called sword for short) which penetrates into one edge face of a stack and thereby divides the stack into two layers.

Dividing apparatus of the above outlined character normally comprise a tongs or analogous means for gripping a stack in the region of the edge which is to be entered into by the sword. As a rule, one jaw of the tongs is adjustable substantially at right angles to the general plane of the dividing sword, and the other jaw of the tongs is biased by one or more springs or the like so as to yieldably bear against the adjacent outermost sheet or panel of the stack in the tongs. Furthermore, conventional dividing apparatus which embody the just discussed components further comprise conveyor means for removing successive smaller stacks or layers from the dividing station.

Dividing apparatus for stacks of paper sheets or the like are used in production lines for steno pads, brochures, note books and like commodities. Such apparatus are installed ahead of the stations for machines or apparatus which must receive stacks of predetermined thickness or which cannot process stacks whose thickness exceeds a predetermined value. Thus, if the machine or apparatus at the preceding station of the production line assembles or processes relatively thick stacks of overlapping panels or sheets, the next-following station must be preceded by an apparatus which can reduce the height of stacks to an acceptable value. A machine which cannot treat stacks having a thickness in excess of a given value is a punch which perforates successive stacks along one edge to provide holes for insertion of spiral binders or other means for movably coupling the sheets of a layer or stack to each other. The number of stages during subdivision of a relatively thick stack into thinner stacks or layers depends on the thickness of the original stack and on the desired or permissible thickness or height of the smaller stacks or layers. Thus, a relatively thick stack will have to be divided into more than two layers if the next following station can accept only relatively thin layers, i.e., layers whose maximum permissible thickness is less than one-half the thickness of the original stack. Furthermore, it happens again and again that the thickness of original stacks varies, even if the number of sheets or panels in each of a series of several stacks is the same. In order to take into consideration such unpredictable variations in the height or thickness of original stacks, it is often desirable to carry out the expected or anticipated number of dividing or breaking up operations plus an additional dividing operation to thereby insure that the height of each and every layer is invariably within the desired range. In other words, let it be assumed that the height of each of a series of successive stacks is a whole multiple, or close to a whole multiple, of the desired maximum height of a layer. Such stacks are subjected to n (instead of $n-1$) dividing operations (wherein n is the theoretical number of satisfactory layers which can be obtained from a stack) whereby the last or n-th dividing step is carried out for the sole purpose of insuring that the thickness of the last layer will not exceed the permissible maximum value. Similar results can be achieved by appropriate positioning of the adjustable jaw of the aforementioned tongs so that the thickness of each layer is less than the maximum permissible thickness. In such instances, too, a stack whose thickness matches or approximates a whole multiple of the maximum permissible thickness of a layer will be broken up into layers whose thickness is invariably acceptable for further processing at the next-following station of a production line for note books or the like. In the absence of such precautionary measures, the sword which, as a rule, is rigidly connected with the drive of the dividing apparatus or with the main prime mover of the production line, and which is moved back and forth in rhythm with the operation of other mobile parts, would be likely to penetrate into the last (normally the lowermost) layer of a stack whenever the thickness of such last layer exceeds the permissible value. This will be readily appreciated since the sword normally performs a stroke subsequent to separation of the penultimate layer from the last layer of a stack and before the dividing station receives a fresh stack. Such "superfluous" stroke of the sword is likely to result in deformation and/or other damage to one or more sheets of the last layer if the thickness of the last layer is excessive. Furthermore, and if the stack contains one or more relatively thick sheets (such as panels made of cardboard or the like and serving as covers for the upper sides and/or undersides of discrete layers), the sword is likely to penetrate into a panel. Similar situations can arise when the relatively thick panels are located at the top and the bottom of a stack which is to be subdivided into two or more thinner stacks or layers.

In order to avoid the above-outlined problems which are in part inherent in the presently known dividing apparatus, such apparatus are normally operated at less than maximum speed so that their output is relatively low. Thus, in order to insure that the sword and/or other parts of the dividing apparatus will not damage the sheets of the stacks and/or layers, the output of such apparatus is intentionally reduced in order to operate with a safety factor which is evidently undesirable, especially when the dividing apparatus form part of complete production lines which are set up for the express purpose of maximizing the output. In many production lines, the apparatus for breaking up stacks of paper sheets or the like constitute bottlenecks which limit the output of the entire production line because their operation is slower than necessary to insure the operation of the next-following machine or apparatus at maximum capacity.

OBJECTS AND SUMMARY OF THE INVENTION

An object of the invention is to provide a novel and improved apparatus which can break up stacks of paper sheets or the like into a desired number of thinner stacks or layers and which is more reliable and has a higher output than heretofore known apparatus.

Another object of the invention is to provide a high-speed stack dividing or breaking up apparatus which can treat stacks having sheets of identical thickness as well as stacks wherein sets or groups of relatively thin sheets alternate with relatively thick sheets or panels consisting of cardboard or the like.

A further object of the invention is to provide an apparatus which can be rapidly converted from breaking up stacks into a first number of layers to subdivision of stacks into a different second number of layers or vice versa.

An additional object of the invention is to provide the apparatus with novel and improved means for positioning the stack to be broken up with reference to the sword, and with novel and improved means for removing layers from the dividing station.

Another object of the invention is to provide an apparatus which can subdivide stacks in one or more stages and at one or more stations.

A further object of the invention is to provide an apparatus which can be used to break up thick or thin stacks and which requires a minimum of attention on the part of attendants so that it can be readily incorporated into high-speed production lines for pads, note books and like commodities.

One feature of the invention resides in the provision of an apparatus which is used to subdivide stacks of overlapping sheets into a plurality of layers including a last layer and a preceding or penultimate layer (which may be the first layer) and wherein each stack includes an edge face extending substantially at right angles to the planes of the sheets. The apparatus comprises a tongs having mobile first and second jaws, means for guiding successive stacks into the tongs so that the jaws are disposed in the region of the edge face of the stack in the tongs, a wedge-like sword or another suitable stack dividing tool which is movable into the edge face of the stack in the tongs to subdivide the stack into layers, means for shifting the dividing tool relative to the tongs, means for removing successive layers from the tongs, and means for moving one of the jaws relative to the other jaw along a predetermined path wherein the one jaw has a component of movement substantially at right angles to the planes of sheets in the stack between the jaws (and substantially at right angles to the general plane of the dividing tool). The moving means for the one jaw includes a device for moving the one jaw away from the dividing tool at least subsequent to shifting of the tool in a direction to penetrate intermediate the penultimate and last layers of the stack between the jaws, and for moving the one jaw to a predetermined operative position (for commencing the subdivision of a fresh stack) upon removal of the last layer of the stack from the tongs.

The apparatus preferably further comprises one or more springs or other suitable means for yieldably biasing the other jaw of the tongs in a direction toward the one jaw and toward the dividing tool. Still further, the apparatus preferably comprises means for actuating the moving means for the one jaw in synchronism with the shifting means for the tool. The aforementioned device of the moving means preferably comprises a rotary cam which cooperates with a follower operatively connected to the one jaw, e.g., by means of a bell crank lever one arm of which carries the one jaw and the other arm of which carries the follower. At least one of the jaws may constitute a roller. In accordance with a presently preferred embodiment of the invention, each of the two jaws constitutes an idler roller.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
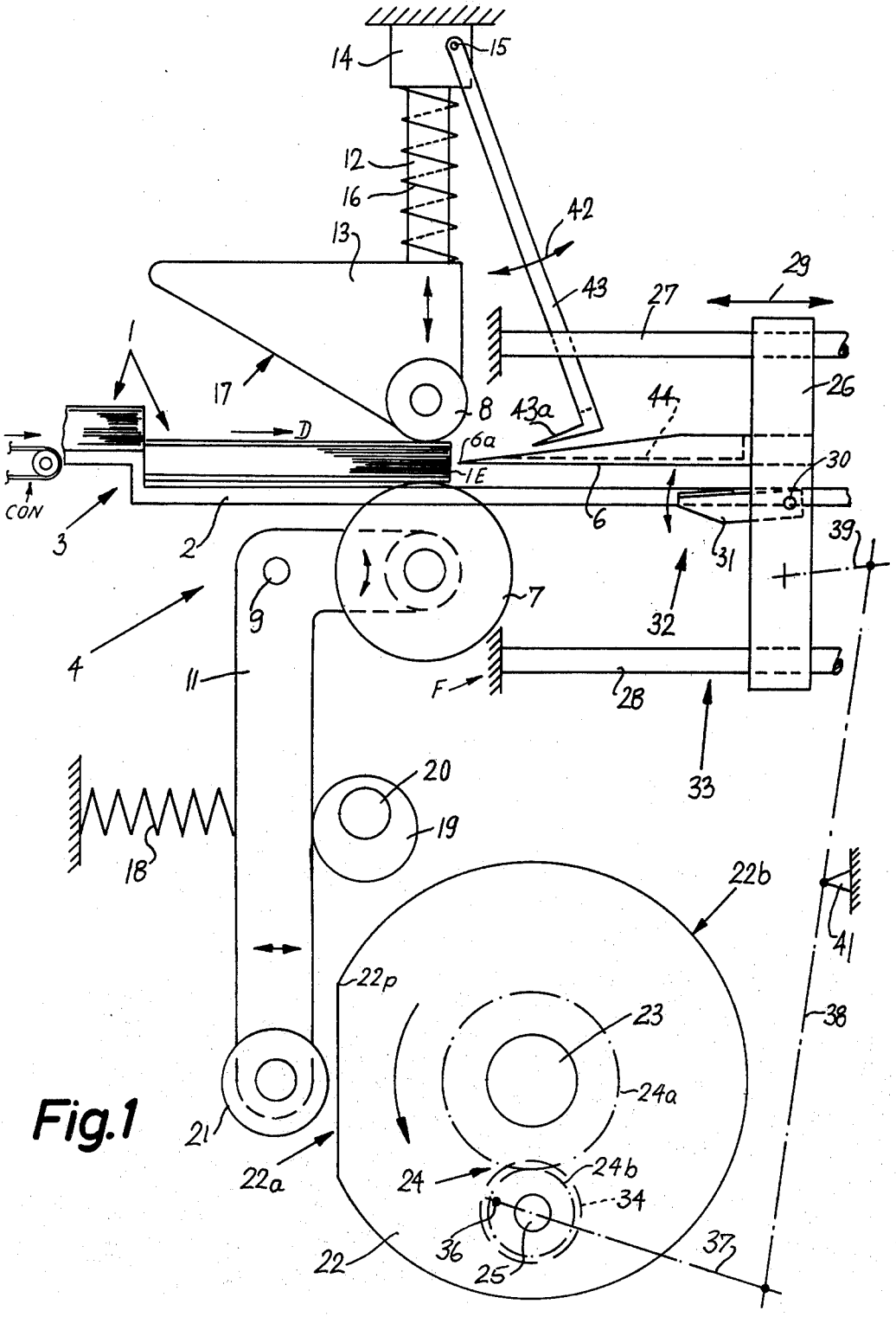
FIG. 1 is a fragmentary schematic partly elevational and partly sectional view of a stack dividing apparatus which embodies one form of the invention and is designed to break up successive stacks into pairs of layers.

Apparatus for subdividing stacks of paper sheets or the like into smaller or thinner stacks or layers are known in the art of making pads, note books or the like. Therefore, the drawing merely shows such component parts of the apparatus which are needed for proper understanding of the presently preferred embodiments of the invention.

Referring first to FIG. 1, there is shown an apparatus which serves to subdivide stacks 1 of overlapping paper sheets into pairs of smaller or thinner stacks or layers. The apparatus of FIG. 1 comprises a pair of spaced-apart strip-shaped guiding members 2 (only one shown) which define an elongated path for transport of successive stacks 1 and of portions of such stacks in the direction which is indicated by the arrow D. The conveyor CON which transports successive stacks 1 into the path defined by the guiding strips 2 includes an endless belt, an endless chain or any other suitable means which can deliver successive stacks 1 into the path between the strips 2. These strips define a transversely extending step 3 serving as a back support for that stack 1 which is in the process of being subdivided or broken up into a pair of thinner stacks or layers.

The apparatus of FIG. 1 further comprises a tongs 4 which serves to grip the outermost sheets of the front or foremost stack 1, namely, of that stack whose rear edge face abuts against the step 3. The jaws 7 and 8 of the tongs 4 are rotary idler rollers which engage the front stack 1 in the region of its leading edge face 1E, namely, in that region where a wedge-like dividing tool or sword 6 is caused to penetrate into the foremost stack 1 to thereby initiate the subdivision of such stack into a pair of thinner stacks or layers. The lower roller or jaw 7 is mounted at the free end of the shorter arm of a bell crank lever 11 which is pivotable about the axis of a pin 9 secured to the frame F of the apparatus. The arrangement is such that, when the lever 11 is caused to pivot in a clockwise direction, as viewed in FIG. 1, the roller 7 descends along an arcuate path (i.e., it has a component of movement at right angles to the (horizontal) direction of reciprocatory movement of the sword 6 into or from the space between the rollers 7 and 8, i.e., into and out of the tongs 4). Such component of movement is also normal or substantially normal to the planes of sheets of the foremost stack 1.

The upper roller or jaw 8 of the tongs 4 is mounted on a holder 13 which is movable up and down along an upright post 12. The upper end portion of the post 12 is mounted in a support 14 which is secured to the frame F. A helical spring 16 reacts against the support 14 and bears against the holder 13 so that the latter urges the roller 8 against the exposed upper side of the uppermost sheet of that stack 1 whose rear edge face abuts against the step 3. The underside of the holder 13 is formed with a forwardly and downwardly inclined guide face 17 which is engaged by the leading edge face 1E of the foremost stack 1 during advancement of such stack to the dividing station whereby the holder 13 and its roller 8 are lifted against the opposition of the spring 16.

The bell crank lever 11 which carries the lower roller 7 is biased by a helical spring 18 which urges its lower arm against the periphery of an eccentric stop 19 mounted on the shaft 20 which is rotatable in the frame F to thereby select the uppermost level of the topmost portion of the roller 7. The means for turning the shaft 20 in the frame F and for releasably fixing the shaft 20 and eccentric stop 19 in a selected angular position is not shown in FIG. 1.

The downwardly extending longer arm of the lever 11 carries a roller follower 21 which cooperates with a rotary disc cam 22 mounted on a camshaft 23. The latter can be rotated by a gear train 24 including a larger gear **24*a* on the shaft 23 and a smaller gear 24*b* on the output shaft 25 of an electric motor or another main prime mover of the apparatus. The peripheral cam face of the cam 22 has a flat section 22*a* which allows the lever 11 to engage the eccentric stop 19 under the action of the spring 18. The other section 22*b* of the cam face of the cam 22 has a circular outline and serves to maintain the lower roller 7 of the tongs 4 in a retracted position in which the spring 18 stores energy because the lower arm of the lever 11 does not contact the eccentric stop 19**.

The ratio of the gears **24*a* and 24*b* is two-to-one, i.e., the cam 22 completes one-half of a full revolution in response to rotation of the output element 25** through a full revolution.

The sword 6 is secured to a shifting means here shown as a slide or carriage 26 which is a platen reciprocable along several horizontal tie rods (FIG. 1 shows two tie rods numbered 27 and 28) mounted in the frame F. The directions in which the carriage 26 is reciprocable along the tie rods 27 and 28 are indicated by a double-headed arrow 29. The carriage 26 further supports an adjustable gripper or jaw 31 which forms part of a second tongs or pincers 32 further including the dividing sword 6. The carriage 26 and the pincers 32 thereon constitute a conveyor 33 which serves to move divided (thinner) stacks or layers of paper sheets away from the dividing station, i.e., in a direction to the right, as viewed in FIG. 1, and into the range of a conveyor system which transports the layers to the next processing station, e.g., to a station where the sheets of each layer are formed with a row of perforations for insertion of spiral binders or the like in order to convert the layers into note books, pads, calendars or the like.

The details of a carriage which can be used in the apparatus of FIG. 1 are disclosed, for example, in German Auslegeschrift No. 2,225,063 to which reference may be had, if necessary. The sole notable difference between the carriage which is described in the German publication and the carriage 26 of FIG. 1 is that the adjustable gripper of the pincers on the carriage of the German publication is located at a level above the dividing sword; however, the purpose of the pincers on the carriage of the German publication is the same.

FIG. 1 further shows the means for synchronizing the movements of the carriage 26 with movements of the lower roller 7 of the tongs 4, i.e., with angular movement of the cam 22. Such synchronizing means includes a disc 34 which is driven by the output element 25 of the prime mover and carries an eccentric pin 36 coupled to a link 37 which is articulately connected to one end of a two-armed lever 38. The latter is fulcrumed in the frame F, as at 41, and its upper end portion (as viewed in FIG. 1) is articulately connected to the carriage 26 by a link 39.

The dividing sword 6 further cooperates with a lever 43 which is pivotally secured to the support 14, as at 15, and whose lower end portion comprises bifurcated prongs **43*a* receivable in complementary recesses or grooves 44 of the sword 6. The means for pivoting the lever 43 back and forth in the directions indicated by a double-headed arrow 42 is not specifically shown in the drawing. In its presently preferred form, such means for reciprocating the lever 43 (in synchronism with the sword 6) comprises a suitable cam receiving motion from the output element 25 or from a part which is driven by the element 25**.

The parts 11, 21 and 22 constitute a means for moving the roller 7 relative to the sword 6 in such a way that the roller 7 has a component of movement at right angles to the planes of sheets in the stack between the rollers 7 and 8. The parts 34 and 36–39 synchronize the movements of the shifting means (carriage 26) for the sword 6 with the movements of the roller 7 relative to the roller 8 and sword 6.

The operation of the apparatus of FIG. 1 is as follows

As mentioned above, the height of each paper stack 1 is such that a single division or breaking up (into two discrete layers) suffices to obtain smaller or thinner stacks each of which is ready to be processed at the next station, such as the aforediscussed perforating station. The angular position of the eccentric stop 19 is selected in dependency on the height of the stacks 1 in such a way that, when the lower arm of the lever 11 engages the eccentric stop 19, the roller 7 maintains the foremost stack 1 in a position in which the edge of the sword 6 is located midway between the two outermost sheets of such stack. This is the so-called operative position of the roller 7. The aforediscussed supply or feeding conveyor CON delivers the foremost stack 1 into the tongs 4 so that the leading edge face 1E of the foremost stack extends slightly beyond the nip of the rollers 7 and 8 (as shown in FIG. 1). During movement of the foremost stack 1 to the illustrated position, the uppermost sheet of such stack raises the holder 13 because the stack slides along the inclined guide face 17 whereby the roller 8 rises against the opposition of the spring 16. The foremost stack 1 comes to rest when its rear edge face descends along and is adjacent to the step 3. In such position of the foremost stack, the rollers 7 and 8 respectively engage the lowermost and the uppermost sheets, the rear edge face of the stack is adjacent to the step 3, the spring 16 is stressed to urge the roller 8 against the topmost sheet of the foremost stack, and the rollers 7 and 8 maintain the stack 1 in a position in which the edge of the sword 6 is located midway between the upper side and the underside of the foremost stack.

The gripper 31 is pivoted to the illustrated position (about a horizontal pivot pin 30 which is secured to the carriage 26) before the carriage 26 is caused to move in a direction to the left, as viewed in FIG. 1, whereby the edge 6*a* of the sword 6 penetrates into the front edge face of the foremost stack 1 between the rollers 7 and 8 of the tongs 4. The output element 25 drives the camshaft 23 via gear train 24 so that the cam face portion 22*p* between the sections 22*a* and 22*b* engages the roller follower 21 immediately or shortly after the edge 6*a* enters the foremost stack 1. The cam 22 then begins to pivot the lever 11 in a clockwise direction, as viewed in FIG. 1, whereby the roller 7 descends, i.e., the tongs 4 opens to reduce the resistance which the foremost stack 1 offers to further penetration of the wedge-like sword 6. As the sword 6 continues to penetrate into the stack 1, the lever 43 is also pivoted (in a clockwise direction, as viewed in FIG. 1) to introduce the prongs 43*a* into the recesses 44 of the sword 6. The prongs 43*a* then carry the upper layer or half (penultimate layer) of the divided stack 1. In the next step, the gripper 31 is pivoted in a clockwise direction, as viewed in FIG. 1, to engage the underside of the lower or last layer or half of the divided foremost stack 1 so that such lower half can be withdrawn when the sword 6 begins to move away from the tongs 4. Once the sword 6 is retracted, the lever 43 is pivoted back to the illustrated position so that the upper half of the divided foremost stack descends onto the lower roller 7 of the tongs 4. At such time, the roller 7 is still held in the lower end position because the roller follower 21 continues to track the section 22*b* of the rotating cam 22.

The gripper 31 is returned to the open position when the lower half of the freshly divided stack 1 is removed from the dividing station. The carriage 26 is then moved back in a direction toward the tongs 4. Since the roller 7 continues to dwell in the lower end position, the sword 6 has ample room to move above the uppermost sheet of the lower half of the divided stack 1. As the sword 6 moves in a direction to the left, it engages and lifts the roller 8 against the opposition of the spring 16. The movement of the sword 6 toward the step 3 is completed when, after pivoting of the gripper 31 back to its operative position, the pincers 32 can properly engage the lower half of the divided stack for transport in a direction to the right, i.e., toward the perforating station. At the same time, a fresh stack 1 is introduced into the tongs 4 so that such fresh stack can be divided into two layers of equal height in a manner as described above. The introduction of a fresh stack 1 into the tongs 4 takes place simultaneously with engagement of the follower 21 by the cam face section 22*a* so that the spring 18 is free to return the lower arm of the lever 11 into engagement with the eccentric 19 and the roller 7 is caused to reassume its operative position. The aforedescribed sequence of steps is then repeated.

An important advantage of the improved apparatus is that the sword 6 is invariably free to move above the lowermost or last layer of each stack 1 before the lever 11 lowers the roller 7 to a position in which the last or lowermost layer is free to descend to a level at which it is located below the path of movement of the sword in a direction toward the step 3. The sword 6 can move toward the step 3 even if the thickness of the last layer is in excess of the desired or advisable thickness. This insures that, when the thickness of a stack 1 equals a whole multiple of the desired thickness of a layer, the number of dividing steps need not exceed the theoretically required number. Otherwise stated, the additional movement of the sword 6 for the sole purpose of insuring that the last or lowermost layer is not too thick can be dispensed with. This contributes to higher output of the production line which includes the dividing apparatus of FIG. 1 because the breaking up of successive stacks 1 requires a relatively short interval of time.

An advantage of the feature that the lower roller 7 descends while the sword penetrates into the edge face 1E is that the shifting of the sword 6 to its leftmost position, as viewed in FIG. 1, necessitates the exertion of a small force and, therefore, such shifting is less likely to result in damage to the sheets which form the stack 1. Furthermore, a smaller effort is required to remove successive layers from the dividing station.

Figure 2:
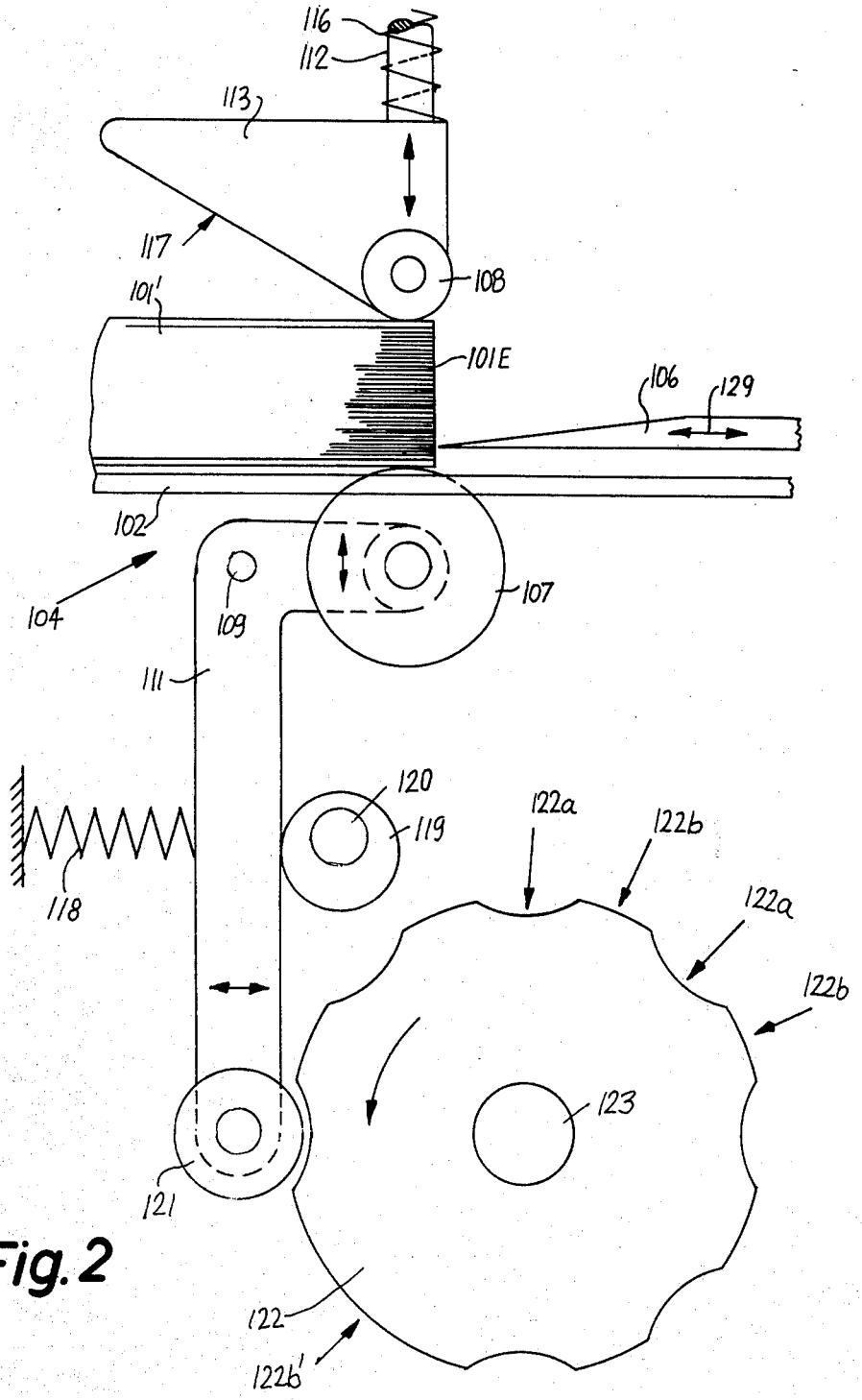
FIG. 2 is a similar fragmentary schematic partly elevational and partly sectional view of a second apparatus which serves to break up each stack into more than two smaller stacks or layers.

The apparatus of FIG. 2 is used to subdivide each of a series of successive stacks 101' into eight thinner stacks or layers. All such parts of this apparatus which are identical with or clearly analogous to corresponding parts of the apparatus of FIG. 1 are denoted by similar reference characters plus 100. FIG. 2 does not show the carriage for the dividing sword 106, the gripper which cooperates with the sword 106 to withdraw successive layers from the dividing station, or the means for shifting the carriage.

The face of the cam 122 comprises seven concave sections 121*a* which are angularly offset by 45 degrees, as considered in the circumferential direction of the cam, seven convex sections 122*b* which alternate with the sections 122*a*, and a further convex section 122*b'* which extends along an arc corresponding to that occupied by two sections 122*a* or 122*b*. The ratio of the speed of the cam 122 to the speed of shifting means for the dividing sword 106 is one-to-eight.

After the sword 106 penetrates into the adjacent edge face 101E of the stack 101' at the dividing station of FIG. 2, the lever 111 is pivoted in a clockwise direction, as viewed in FIG. 2, because its roller follower 121 engages a section 122*b* of the cam 122, i.e., the roller 107 is moved downwardly and away from the roller 108. When the pincers including the sword 106 thereupon completes the removal of the freshly separated layer from the dividing station, the roller follower 121 engages the adjacent section 122*a* whereby the spring 118 returns the lever 111 to a position corresponding to the operative or raised position of the roller 107. The same sequence of steps is repeated seven times whereupon the roller follower 121 engages the convex section 122*b'* and maintains the roller 107 in the lower end position for a longer interval of time. This insures that the sword 106 can move above the lowermost or last layer of the subdivided stack without any interference on the part of such last layer.

Figure 3:
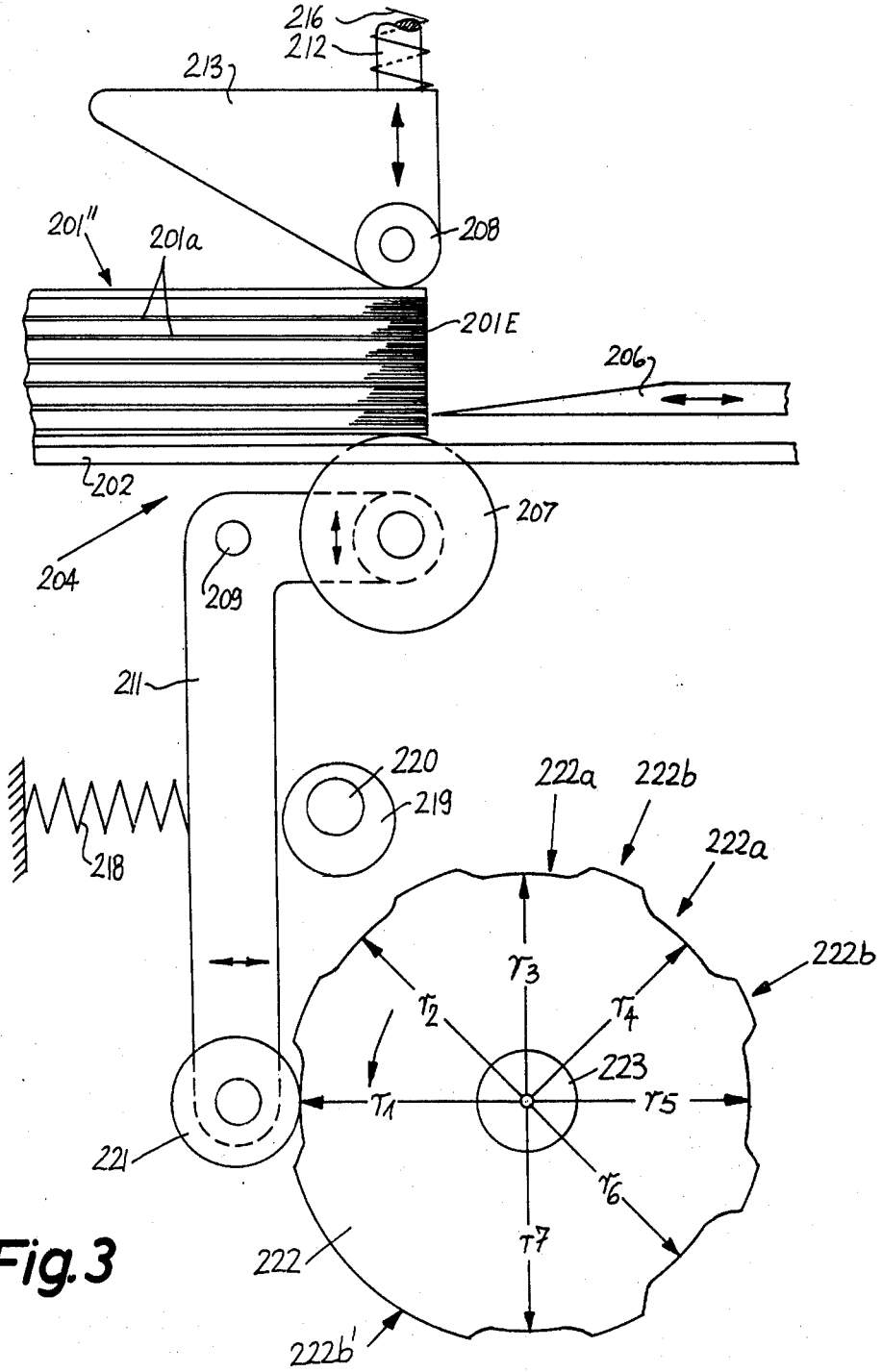
FIG. 3 is a similar view of a third apparatus which serves to break up stacks into layers with covers which are made of cardboard and are inserted into the stacks prior to subdivision into layers.

FIG. 3 illustrates a third apparatus wherein all such parts which are identical with or analogous to those of the apparatus of FIG. 2 are denoted by similar reference characters plus 100. The apparatus of FIG. 3 serves to break up each of a series of successive stacks 201" wherein sets of overlapping paper sheets alternate with relatively thick sheets 201*a*, e.g., cover panels made of cardboard or the like.

The eccentric stop 219 in not used, i.e., it is moved to an angular position in which it cannot be engaged by the lower arm of the lever 211. This is due to the fact that the roller follower 221 of the lever 211 is in permanent contact with the peripheral surface of the rotary cam 222. The spring 218 serves to bias the lever 211 in a counterclockwise direction, i.e., to urge the roller follower 221 against the cam 222 and to simultaneously urge the roller 207 of the tongs 204 to its upper end position or operative position. The eccentric 219 and its shaft 220 can be omitted.

In this embodiment of the apparatus, the sections 222*a* of the face of the cam 222 perform the function of abutments or stops for the lever 211. By appropriate selection of radial distances r1, r2, r3, r4, r5, r6 and r7 between the axis of the cam 222 and the sections 222*a* (each of these radial distances is different), the positions of the lower roller 207 of the tongs 204 are selected in such a way that, during each penetration into the edge face 201E of the adjacent stack 201", the sword 206 enters above or below the corresponding thicker sheet or cover 201*a*. It is clear that the distance between successive sections 222*a* and the axis of the shaft 223 for the cam 222 need not vary at a constant rate, i.e., the apparatus of FIG. 3 can divide stacks 201" into layers including relatively thick as well as relatively thin layers. In other words, the thickenesses of all layers which are obtained in response to division of a stack 201" by the sword 206 need not be the same.

Furthermore, by the simple expedient of replacing the cam 222 with a differently configurated cam, the sword 206 can divide each stack 201" into a larger or smaller number of layers, depending on the number of inserted cardboard panels 201*a* if each layer is to include a panel 201*a* and if each panel is to be located at the top or at the bottom of the respective layer. The manner in which the sword 206 is shifted is preferably the same as described in connection with FIG. 1.

In heretofore known apparatus for breaking up stacks with cardboard panels between the sheets, the thickness of cardboard panels had to be selected in such a way that it did not match a whole multiple of the thickness of a layer. This often necessitated the selection of layers whose thickness was well below the maximum permissible thickness. In other words, the machine at the next-following station (downstream of a conventional dividing apparatus) was not used to capacity with attendant reduction of the output of the entire production line. The apparatus of FIG. 3 avoids the drawbacks of the just described conventional dividing apparatus by the simple expedient of using a cam 222 wherein the sections 222*a* are located at different distances from the axis of the camshaft 223.

The provision of jaws in the form of idler rollers (such as 207 and 208) reduces the resistance which the tongs offers to introduction of a fresh stack.

Figure 4A:
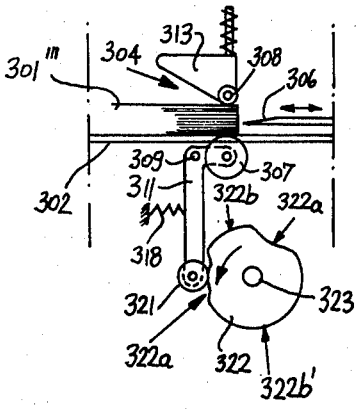
FIG. 4 (composed of FIGS. 4A and 4B) is a schematic partly elevational and partly sectional view of a fourth apparatus wherein the subdivision of successive stacks into six layers each takes place at two different stations.
Figure 4B:
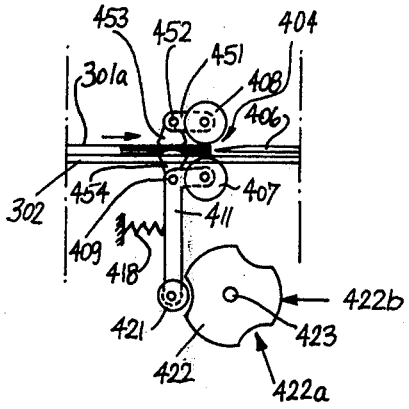

FIGS. 4A and 4B illustrate a further apparatus which serves for subdivision of each stack 301''' into six layers. The subdivision takes place at two stations including a first station A (shown in FIG. 4A) at which each of a series of stacks 301''' is subdivided into three smaller stacks 301*a*, and a second station B (see FIG. 4B) at which successive smaller stacks 301*a* are subdivided into pairs of layers of identical or different thicknesses.

The dividing unit at the station A is very similar to the apparatus of FIG. 3 and, therefore, all such parts of this unit which are identical with or clearly analogous to the corresponding parts of the apparatus of FIG. 23 are denoted by similar reference characters plus 100. The face of the cam 322 comprises two concave sections 322*a*, a convex section 322*b* between the sections 322*a*, and a longer convex section 322*b*'diametrically opposite the section 322*b*. The distance between the axis of the shaft 323 and each of the sections 322*a* is the same. The section 322*b* pivots the lever 311 during first penetration of the sword 306 into the stack 301''' at the station A, and the section 322*b*' maintains the roller 307 in the lower end position during the second and third movements of the sword 306 into the space between the rollers 307, 308 of the tongs 304. The sword 306 effects a second division or subdivision of the stack 301''' during second penetration whereas the third movement of the sword into the space between the rollers 307, 308 merely serves for removal of the last or lowermost smaller stack 301*a* to the station B.

The ratio of the speed of the cam 322 to the speed of movement of means for shifting the sword 306 is one-to-three. The sword 306 can cooperate with a gripper (not shown) of the pincers on the carriage for the sword to transfer successive smaller stacks 301*a* from the station A to the station B. All such parts of the dividing unit at the station B of FIG. 4B which are identical with or clearly analogous to the corresponding parts of the unit at the station A of FIG. 4A are denoted by similar reference characters plus 100. The face of the cam 422 in the dividing unit at the station B comprises three equidistant concave sections 422*a* which alternate with an equal number of equidistant convex sections 422*b*. The upper roller 408 of the tongs 404 is mounted on a lever 451 which is turnable about the axis of a shaft 452. The lever 451 carries or is made integral with a gear segment 453 meshing with a complementary gear segment 454 on the lever 411 for the roller 407. Thus, when the roller 407 moves away from the underside of a thinner stack 301*a*, the roller 408 moves away from the upper side of such stack, and vice versa. The dividing sword 406 is stationary, and its edge is disposed midway between the rollers 407, 408.

Apparatus for dividing stacks of sheets wherein the division is carried out by resorting to a stationary sword are known in the art. Therefore, FIG. 4B does not show all details of the unit at the station B. For example, the unit at the station B comprises a conveyor which removes successive layers (halves of the smaller stacks 301*a*) from the station B. Also, the unit at the station B may comprise a conveyor, other than that including the sword 306, for delivery of stacks 301*a* from the station A to the station B.

An important advantage of the unit at the station B of FIG. 4B is that the kinematic connection between the rollers 407 and 408 of the tongs 404 (by way of the levers 411, 451 and gear segments 454, 453) insures automatic centering of each stack 301*a* with reference to the stationary sword 406 when a stack 301*a* enters the space between the rollers 407 and 408. The cam 422 performs a function which is similar to that of the cams in the previously described embodiments, i.e., it can relieve the pressure of rollers 407, 408 upon successive layers 301*a* when the lever 411 is pivoted in a clockwise direction, as viewed in FIG. 4B, because its roller follower 421 is engaged by a cam section 422*b*. Such pivoting of the lever 411 entails a downward movement of the roller 407 and a simultaneous upward movement of the roller 408. Relaxation of roller pressure upon a stack 301*a* takes place automatically when the leader of the stack 301*a* is advanced sufficiently to be penetrated into by the edge of the stationary sword 406.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. In an apparatus for dividing stacks of overlapping sheets into a plurality of layers including a last layer and a preceding layer and wherein each stack includes an edge face extending substantially at right angles to the planes of the sheets, the combination of a tongs having mobile first and second jaws; means for guiding successive stacks into said tongs so that the jaws are disposed in the region of the edge face of the stack in said tongs; a dividing tool movable into the edge face of the stack in said tongs to subdivide the stack into layers; means for shifting said tool relative to said tongs; means for removing successive layers from said tongs; and means for moving one of said jaws relative to the other jaw along a predetermined path wherein said one jaw has a component of movement substantially at right angles to the planes of sheets in the stack between said jaws, said moving means including a device for moving said one jaw away from said tool at least subsequent to shifting of said tool in a direction to penetrate intermediate said other jaw and the last layer of the stack between said jaws and for moving said one jaw to a predetermined operative position upon removal of the last layer of a stack from said tongs.

2. The combination of claim 1, wherein said tool is a wedge-like sword which is reciprocable toward and away from said tongs.

3. The combination of claim 1, further comprising means for yieldably biasing said other jaw of said tongs toward said one jaw.

4. The combination of claim 1, further comprising means for actuating said moving means in synchronism with said shifting means.

5. The combination of claim 1, wherein said tool is arranged to break up the stack between said jaws into more than two layers and said device includes means for moving said one jaw away from said tool subsequent to the last of several penetrations of said tool into different portions of the edge face of the stack between said jaws.

6. The combination of claim 1, wherein said device includes means for moving said one jaw away from said tool during penetration of said tool into the edge face of the stack in said tongs.

7. The combination of claim 1, wherein said device includes means for moving said one jaw away from said tool to at least two different positions.

8. The combination of claim 1, wherein said device includes a rotary cam.

9. The combination of claim 8, wherein said moving means further comprises means for rotating said cam so that the latter completes one full revolution during subdivision of a stack in said tongs.

10. The combination of claim 1, wherein said moving means includes a lever which is pivotable about a fixed axis and said one jaw is mounted on said lever.

11. The combination of claim 10, further comprising adjustable stop means for limiting the movement of said one jaw toward said tool.

12. The combination of claim 11, wherein said stop means includes a rotary eccentric.

13. The combination of claim 1, wherein said moving means includes a follower operatively connected with said one jaw and said device includes a rotary cam having at least one section which is tracked by said follower during movement of said one jaw away from said other jaw.

14. The combination of claim 13, wherein said cam has several sections which are tracked seriatim by said follower during successive movements of said one jaw away from said other jaw, each of said sections being disposed at a different distance from the axis of said cam.

15. The combination of claim 1, wherein at least one of said jaws is a roller.

16. The combination of claim 15, wherein each of said jaws is an idler roller.

17. The combination of claim 1, wherein said removing means includes at least a portion of said dividing tool.

* * * * *